US006120981A

United States Patent [19]

Hoke et al.

[11] Patent Number: 6,120,981

[45] Date of Patent: Sep. 19, 2000

[54] PHOTOGRAPHIC ELEMENT CONTAINING SULFON AMIDO COMPOUNDS THAT BOOST DYE FORMATION FROM PHOTOGRAPHIC COUPLERS

[75] Inventors: David Hoke; Jared B. Mooberry, both of Rochester; Kathleen M. Yahn, Scottsville; Kevin P. Dockery; David T. Southby, both of Rochester, all of N.Y.

[73] Assignee: Eastman Kodak Company, Rochester, N.Y.

[21] Appl. No.: 09/224,425

[22] Filed: Dec. 31, 1998

[51] Int. Cl.[7] ..... G03C 1/08; G03C 7/26; G03C 7/32

[52] U.S. Cl. ..... 430/543; 430/546; 430/551; 430/631; 430/552; 430/553; 430/554; 430/555; 430/556; 430/557; 430/558

[58] Field of Search ..... 430/543, 551, 430/552, 553, 554, 555, 556, 557, 558, 546, 631

[56] References Cited

U.S. PATENT DOCUMENTS

| | | | |
|---|---|---|---|
| 4,840,877 | 6/1989 | Abe et al. | 430/551 |
| 4,973,535 | 11/1990 | Merkel et al. | 430/551 |
| 5,120,636 | 6/1992 | Takahashi et al. | 430/546 |
| 5,382,500 | 1/1995 | Sugita et al. | 430/505 |
| 6,004,736 | 12/1999 | Taguchi et al. | 430/543 |

FOREIGN PATENT DOCUMENTS 07209839 of 0000 Japan .

*Primary Examiner*—Geraldine Letscher
*Attorney, Agent, or Firm*—Arthur E. Kluegel

[57] ABSTRACT

Disclosed is a photographic element comprising a light-sensitive silver halide emulsion layer having associated therewith a dye-foaming coupler compound and a sulfonamido compound (a) bearing on the sulfur atom of the sulfonamido group an alkyl group and (b) bearing on the nitrogen atom of the sulfonamido group both a hydrogen atom that exhibits a pKa value of less than 9 and a second substituent that is either (1) an aryl group containing one or more electron withdrawing substituents for which the sum of the Hammett's values ($\Sigma\sigma_p$) is greater than 0.5, or (2) a heteroaryl group.

18 Claims, No Drawings

PHOTOGRAPHIC ELEMENT CONTAINING SULFON AMIDO COMPOUNDS THAT BOOST DYE FORMATION FROM PHOTOGRAPHIC COUPLERS

FIELD OF THE INVENTION

This invention relates to a photographic element comprising a light-sensitive silver halide emulsion layer containing a color forming, coupler and an N-aryl-sulfonamido compound bearing a hydrogen atom on the sulfonamido nitrogen atom.

BACKGROUND OF THE INVENTION

Conventional silver halide color photographic elements contain a number of silver halide emulsion layers. These layers are spectrally sensitized to particular colors of light and have associated therewith coupler compounds capable of forming image dyes upon contact with oxidized developer. In order to obtain an image in a desirable processing time, it is necessary that the coupler have sufficient activity to form the image in the allowed processing time. This requires a certain minimum range of reactivity. When the image is ultimately comprised of more than one dye, it is further necessary that the reactivity of the couplers of different colors be balanced so as to enable a proper neutral color when needed.

When a coupler provides an image dye having desirable hue, the coupler is of no practical utility unless it is sufficiently reactive with oxidized developer to produce the desire maximum density in the desired time. Hydrophilic substituents on couplers have been used effectively to lower the apparent dispersion pKa (known as pH ½) of the coupler. They increase the hydrophilicity of the coupler/coupler solvent particles. However, such substituents may have adverse effects on other aspects of the couplers' performance. Couplers must have manufacturable syntheses, and yield dyes which absorb in the correct region of the visible spectrum and which are resistant to fading by light, heat and humidity. Also, the couplers must be active, have a low propensity to form fog, be easily dispersible and must themselves be resistant to the deleterious actions of light, heat and humidity.

U.S. Pat. No. 4,840,877 (Fuji) discloses the use of ballasted carboxylic acids with magenta dye forming couplers to improve the coupler performance. The acids reduce coupler/silver interactions which may lead to speed losses, and the acids improve the efficiency of dye formation.

U.S. Pat. No. 5,382,500 (Fuji) includes sulfonamides in green sensitive layers. Pyrazolotriazoles are coated in combination with at least one non-color forming compound which is either a sulfonamide or a phenol. These mixtures have improved keeping (less silver interaction under high temperature or/and high humidity conditions) and improved process pH sensitivity. The sulfonamide definition includes N- and S-substituents that are aryl groups and further that the N-substituent has a p-group that has Hammett $\sigma_p$>negative 0.4. In the examples, one structure has the N-substituent as 2,4,6-trichlorophenyl ($\Sigma\sigma_p$=0.69) and a phenyl rather than an alkyl S-substituent.

JP 07209839 A2 claims sulfonamides as development accelerators in heat-developable systems in combination with dye releasing reductants. The closest structure is of the form Ar—$SO_2$NH—Ar—(m-$SO_2$NHR).

U.S. Pat. No. 4,973,535 describes the use of sulfonamide solvents to alter the hue of couplers. Formula 2 (col. 4) includes $C_4H_9SO_2NH$-Ph-$C_2H_5$ and Formula 4 includes $C_7H_{15}SO_2NH$-Ph-3,4-diCl ($\Sigma\sigma_p$=0.46).

U.S. Pat. No. 5,120,636 (Fuji) discloses a combination of a magenta coupler, solvent and a bis-phenol for improved light fastness. The solvent general structure includes sulfonamides where one or both substituents can be aryl. The example structures are all high pKa sulfonamides.

A problem to be solved is to find an addenda compound that will improve the reactivity of a coupler when the reactivity is otherwise unacceptable.

SUMMARY OF THE INVENTION

The invention provides a photographic element comprising a light-sensitive silver halide emulsion layer having associated therewith a dye-forming coupler compound and a sulfonamido compound (a) bearing on the sulfur atom of the sulfonamido group an alkyl group and (b) bearing on the nitrogen atom of the sulfonamido group both a hydrogen atom that exhibits a pKa value of less than 9 and a second substituent that is either (1) an aryl group containing one or more electron withdrawing substituents for which the sum of the Hammett's values ($\Sigma\sigma_p$) is greater than 0.5, or (2) a heteroaryl group.

The invention also provides a process for forming an image in such an element.

The element of the invention contains an addenda compound that improves the reactivity of a coupler when the reactivity is otherwise unacceptable.

DETAILED DESCRIPTION OF THE INVENTION

The element of the invention is generally as described in the Summary of the Invention.

The alkyl group on the sulfur atom of the sulfonamido group is suitably one having from 1–4 carbon atoms such as a methyl, ethyl or butyl group. Unsubstituted alkyl groups are conveniently employed.

The substituent on the nitrogen atom of the sulfonamido group is either an aryl or heteroaryl group. To insure the effectiveness of the compound, the aryl substituent must have sufficient electron withdrawing capacity when the substituent is a carbocyclic aryl group, and so it is desirable that the aryl ring contain one or more substituents such that the sum of the Hammett's sigma para values ($\Sigma\sigma_p$) for the substituents is greater than 0.5. This may be accomplished with a single or with multiple substituent groups. Particularly preferred are the aryl groups containing the substituents —$SO_2$R where R is an alkyl, aryl, alkoxy, aryloxy or an alkyl- or arylamino group. Especially desirable is such a substituent where R is aryloxy- such as phenoxy or naphthoxy or alkylamino- such as methylamino-octadecyl, methylamino, octadecylamino, and piperidino groups.

There may be from 1–5 substituents on the aryl group bonded to the nitrogen atom of the sulfonamido group. Together the substituent groups on the compound of the invention must be sufficient to ballast the compound in the photographic element. Thus, the compound must have sufficient overall hydrophobicity, to prevent the compound from diffusing in the photographic element during manufacture, storage or processing, Typically, the compound must possess at least 7 and desirably at least 12 carbon atoms. This is conveniently accomplished by including an alkyl group of from 12 to 18 carbon atoms.

The compound has a sulfonamide hydrogen exhibiting a pKa less than 9 to provide an effective improvement in reactivity. The sulfonamide NH has a pKa low enough that it is substantially ionized at the pH of the photographic developing solution or during development if aqueous solutions are not involved. The addendum can be co-dispersed with the coupler in coupler solvent or may be added to the melt as a separate dispersion. The compound increases the amount of dye formation, resulting in higher speed and/or gamma in coatings and improved (lower) sensitivity to changes in developer solution pH.

The pKa of the sulfonamide NH is suitably between 5 and 9. It is believed that this enables them to be substantially ionized at the pH of the photographic developing solution, but not at post process pH. The effects are best seen with couplers that have relatively high dispersion pKa values (>10) such as pivaloylacetanilide yellow couplers and azole magenta and cyan couplers.

The addenda of the invention may be further characterized by Formula Inv:

$$(R^1—SO_2NH—)_x—R^2 \quad \text{(Inv)}$$

wherein $R^1$ is a lower alkyl group containing 1–4 carbons.

$R^2$ is an aryl or heteroaryl group bearing a substituent having a Hammett's sigma para value of greater than 0.5. Useful substituents are as described above and include sulfonyl, sulfonyloxy, and sulfamoyl groups such as $—SO_2—Ar$, $SO_2NHR^5$, $SO_2NR^5R^6$, and $SO_2OR^5$ where Ar is an aryl group and $R^5$ and $R^6$ may be alkyl or aryl groups. Other examples are carbamoyl, sulfonamido, ester, carboxyl, and carbonamido groups. If these substituents contain a second low pKa sulfonamido group, or phenol group, then they also desirably contain a hydrocarbon ballast of >4 carbons and preferably >7 carbons. These substituents provide a hydrophobic end to the molecule.

x is an integer of 1 to 6 and suitably 0 to 2.

The addenda may be incorporated as part of the coupler dispersion or as a separate dispersion coated within the same photographic layer as the coupler which they affect. Their level relative to the coupler may be from 0.01 to 10 parts, preferably between 0.1 and 2 parts.

When combined with dye releasing yellow high dye-yield (HDY) couplers, these addenda enhance the reactivity of the less solubilized HDY couplers. These addenda also show promise with other yellow couplers and other film and paper couplers with respect to activity and stability and provide a low cost alternative to developing other, more reactive, couplers.

Strong electron withdrawing groups are useful aryl substituents on the sulfonamido nitrogen. Arylsulfamoyl groups such as $—SO_2—O—$ are preferred to acid groups for activity and because they are not ionized substantially at the post-process pH of the film. Ionization at that point can lead to keeping problems. These addenda do not change the hue of the dye formed from the coupler significantly.

The following are examples of addenda of the invention:

| Formula | Addendum | pKa |
|---|---|---|
| 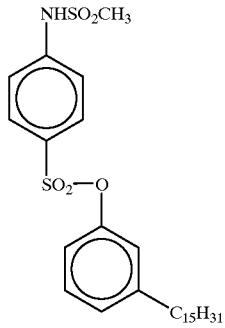 | Inv-1 | 7.55 |
| 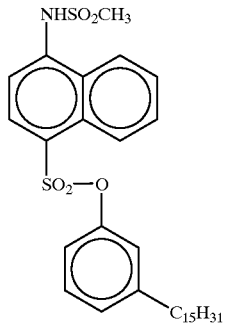 | Inv-2 | 6.07 |

-continued
| Formula | Adden-dum | pKa |
|---|---|---|
| 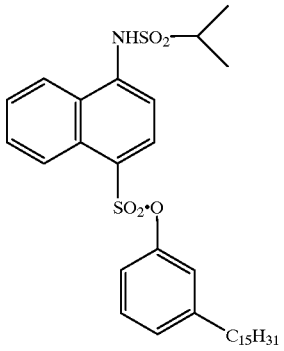 | Inv-3 | 6.3 |
| 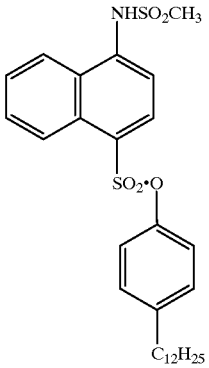 | Inv-4 | 6.1 |
| 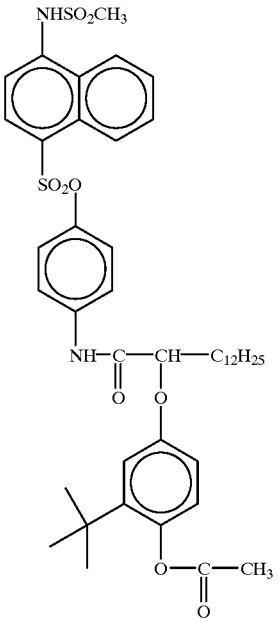 | Inv-5 | 6.07 |

-continued
| Formula | Addendum | pKa |
|---|---|---|
| 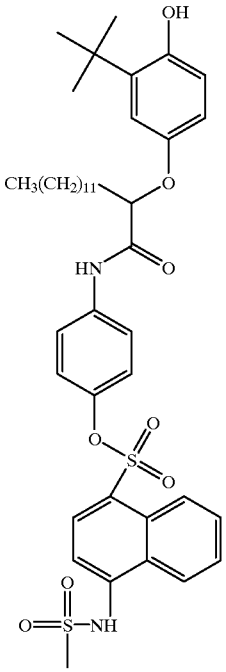 | Inv-6 | 5.98 |
| 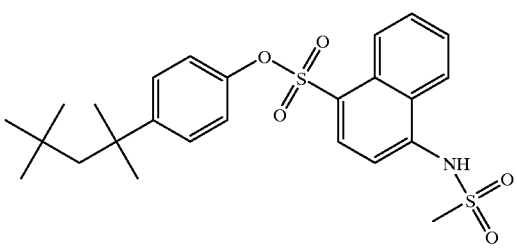 | Inv-7 | 6.15 |
| 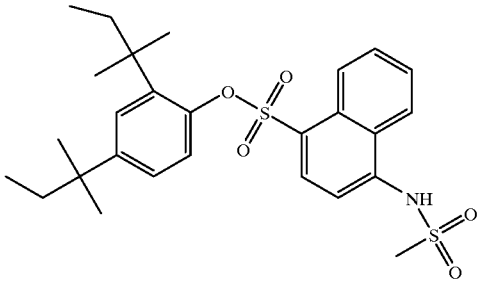 | Inv-8 | 6.21 |
| 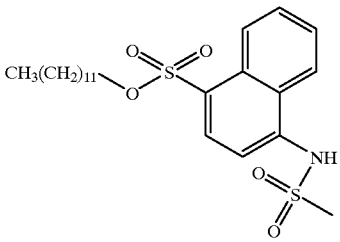 | Inv-9 | 6.33 |

-continued
| Formula | Adden-dum | pKa |
|---|---|---|
| 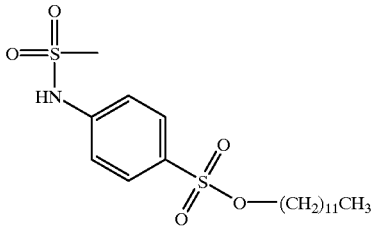 | Inv-10 | 7.66 |
| 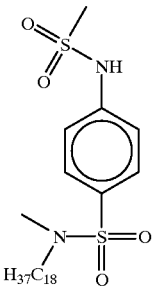 | Inv-11 | 8.03 |
| 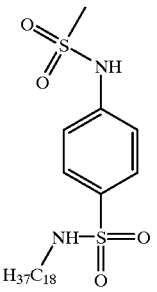 | Inv-12 | 8.15 |
| 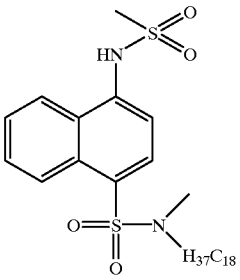 | Inv-13 | 6.77 |

-continued
| Formula | Adden-dum | pKa |
|---|---|---|
| 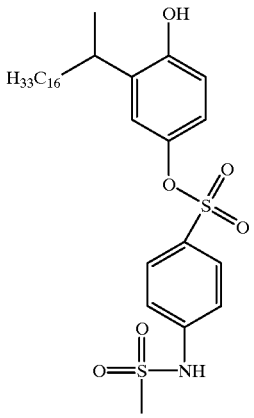 | Inv-14 | 7.53 |
| 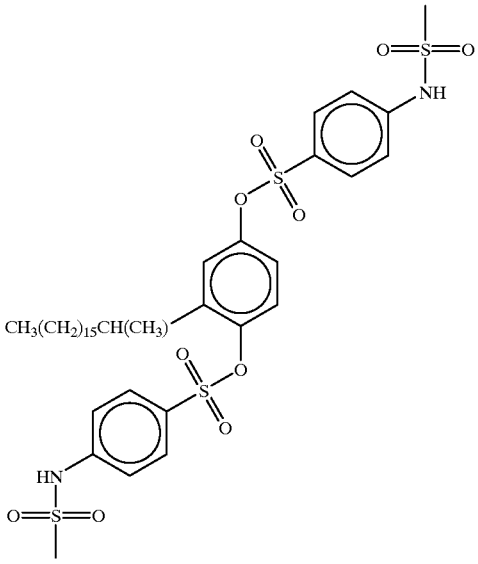 | Inv-15 | 6.87 |
| 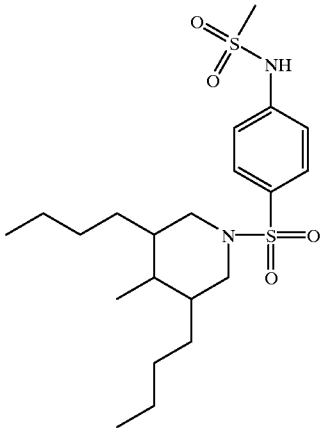 | Inv-16 | 8.12 |

-continued
| Formula | Addendum | pKa |
|---|---|---|
| 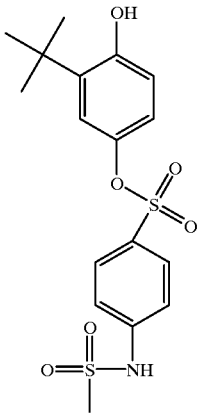 | Inv-17 | 7.54 |
| 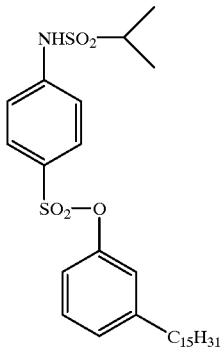 | Inv-18 | 7.8 |
| 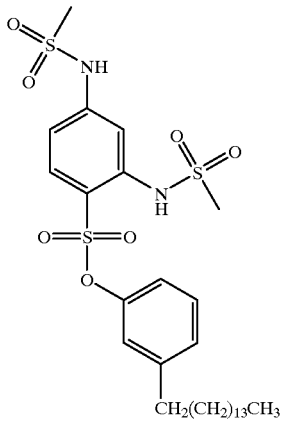 | Inv-19 | 6.43 |
| 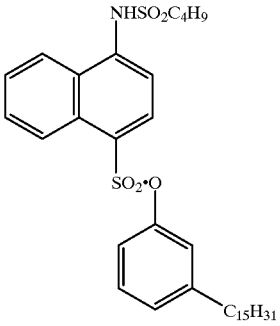 | Inv-20 | 6.39 |

-continued
| Formula | Addendum | pKa |
|---|---|---|
| 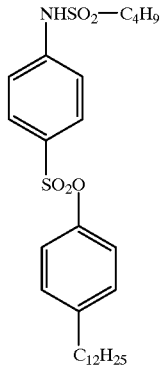 | Inv-21 | |
| 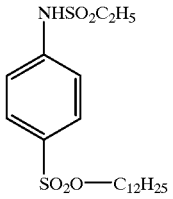 | Inv-22 | |
| 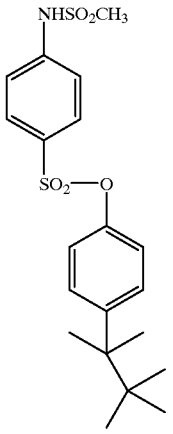 | Inv-23 | |
| 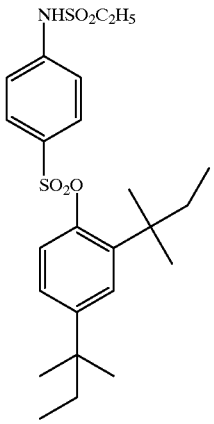 | Inv-24 | |

-continued
| Formula | Addendum | pKa |
|---|---|---|
| 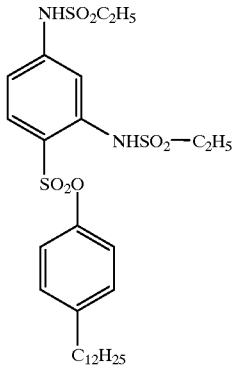 | Inv-25 | |
| 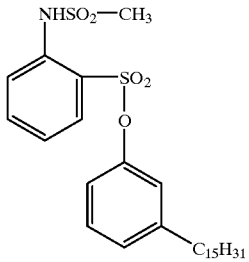 | Inv-26 | |
| 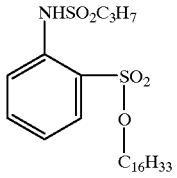 | Inv-27 | |
| 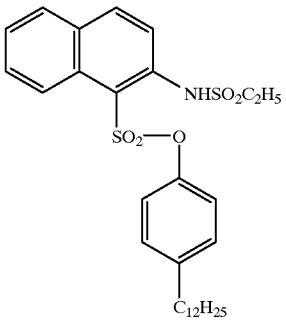 | Inv-28 | |
| 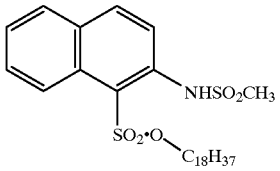 | Inv-29 | |

-continued
| Formula | Addendum | pKa |
|---|---|---|
| 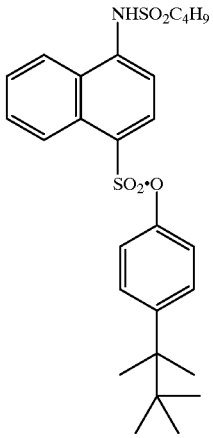 | Inv-30 | |
| 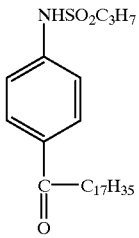 | Inv-31 | |
| 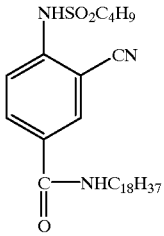 | Inv-32 | |
| 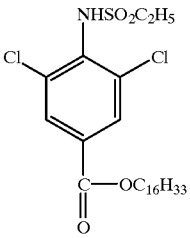 | Inv-33 | |
| 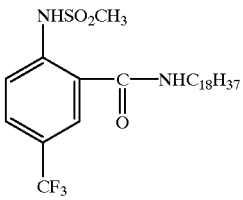 | Inv-34 | |

-continued
| Formula | Addendum | pKa |
|---|---|---|
| 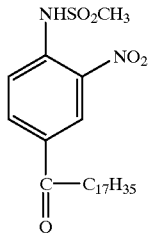 | Inv-35 | |
| 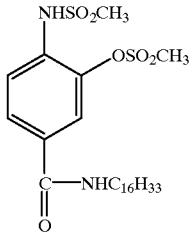 | Inv-36 | |
| 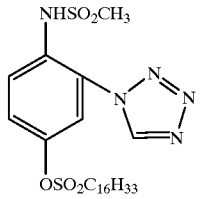 | Inv-37 | |
| 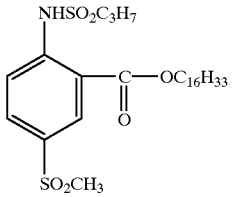 | Inv-38 | |
| 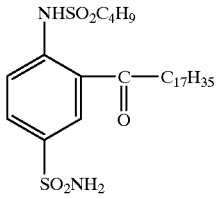 | Inv-39 | |
| 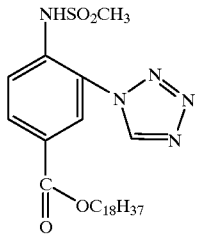 | Inv-40 | |

-continued

| Formula | Addendum | pKa |
|---|---|---|
| 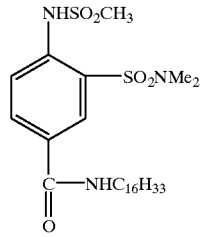 | Inv-41 | |
| 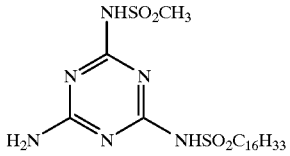 | Inv-42 | |
| 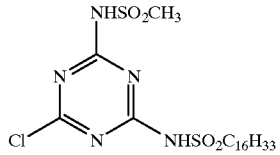 | Inv-43 | |
| 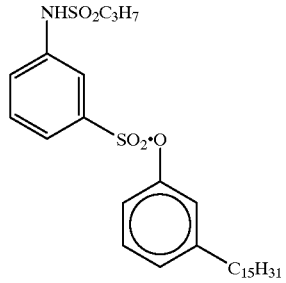 | Inv-47 | |

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubcrsicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5.294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859, 578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543, 323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

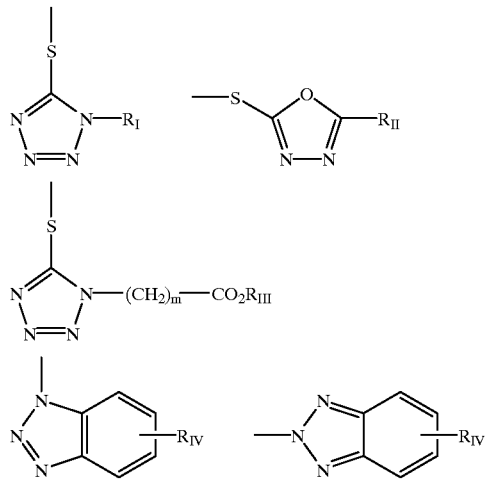

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

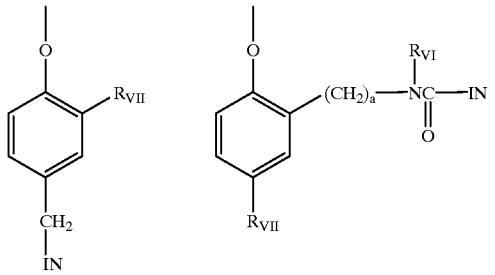

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

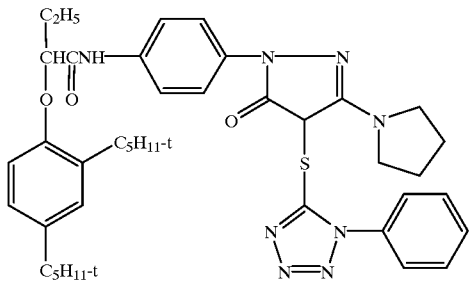

-continued

D2

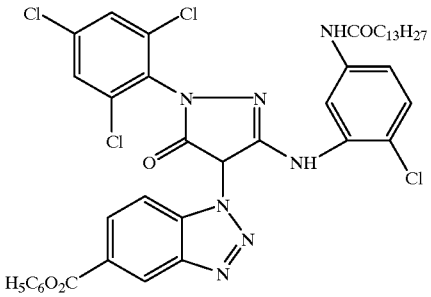

D3

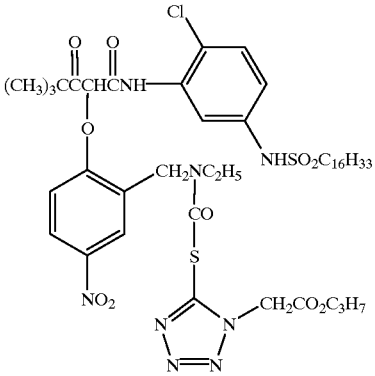

D4

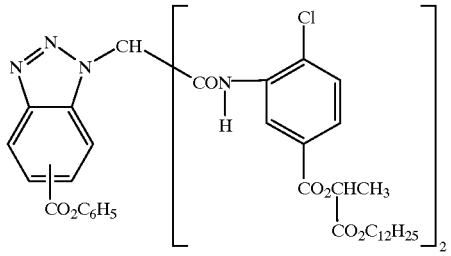

D5

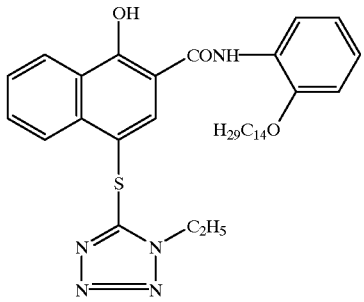

D6

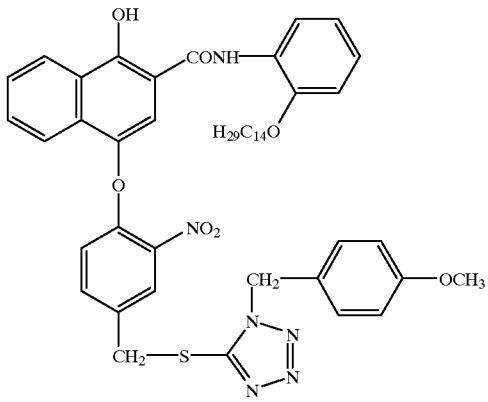

-continued

D7

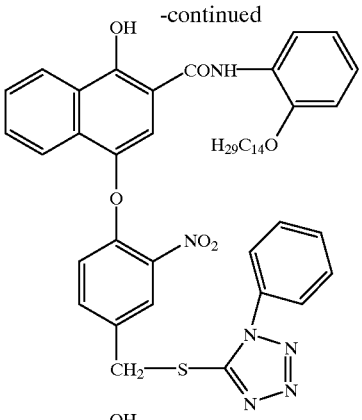

D8

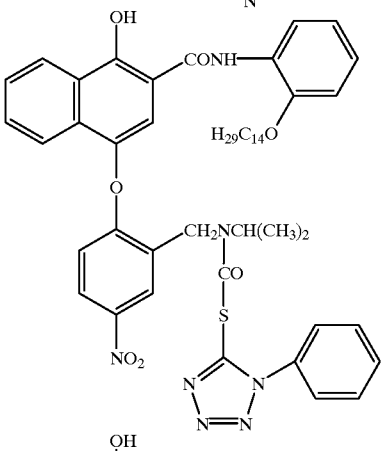

D9

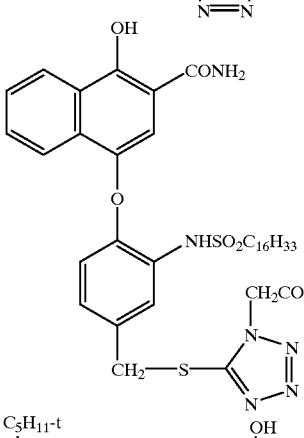

D10

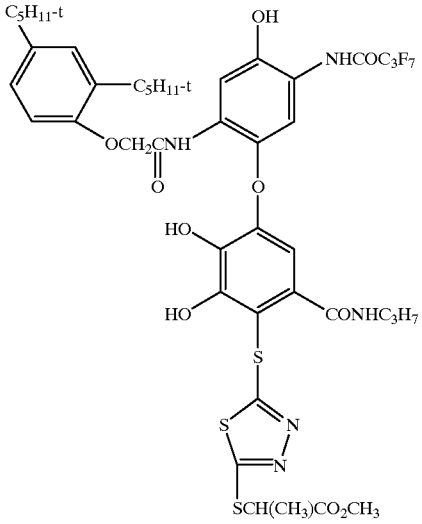

-continued

D11

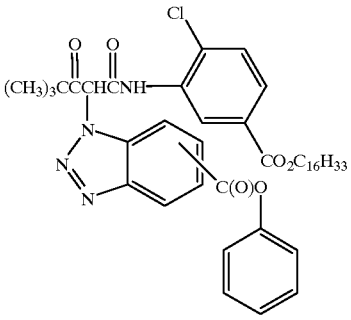

D12

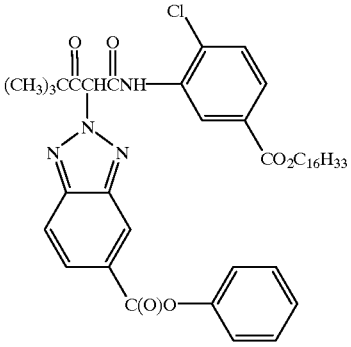

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et at U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et at U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLES

Following are the comparative compounds that were employed in the examples and, where appropriate, their corresponding pKa values:

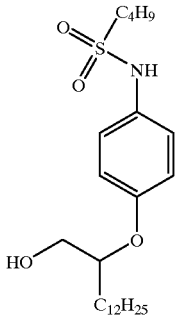

Comp-1 10.57

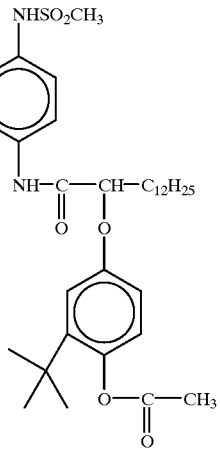

Comp-2 9.56

-continued

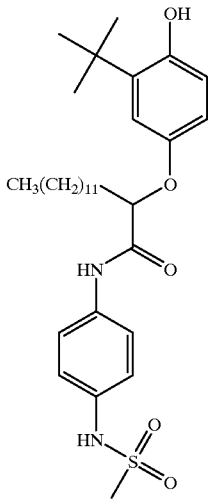

Comp-3 9.54

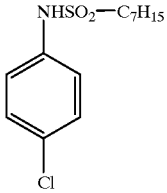

Comp-4 9.44

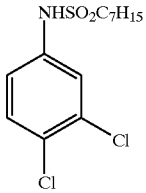

Comp-5 8.66
σ = 0.46

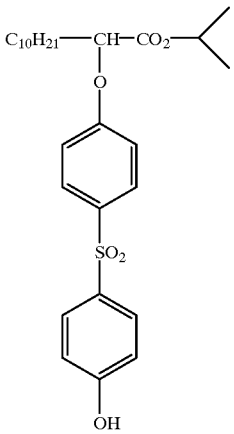

Comp-6

Solvents used were as follows:
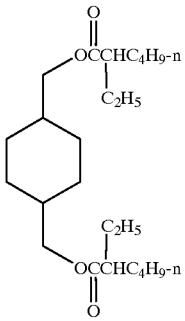
S-2
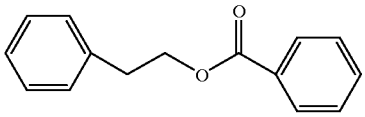
S-3
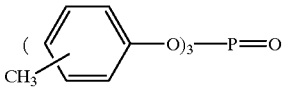
mixed isomers
-continued
S-4
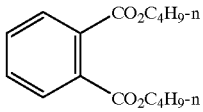
S-5
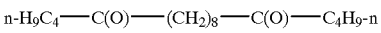
S-6
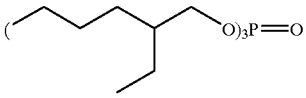
S-7
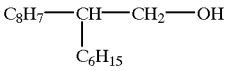
Couplers used were as follows:
CC-1
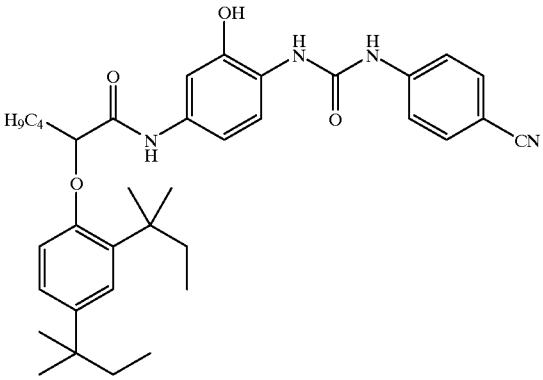
MC-2
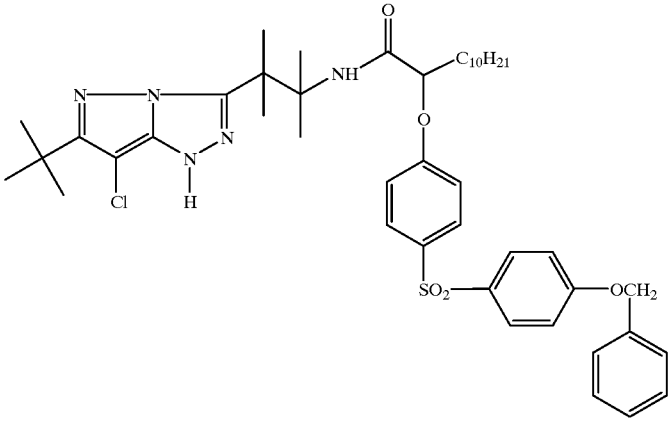

-continued
YC-1
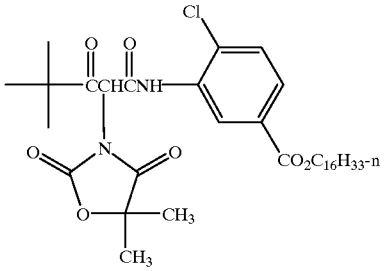
YC-2
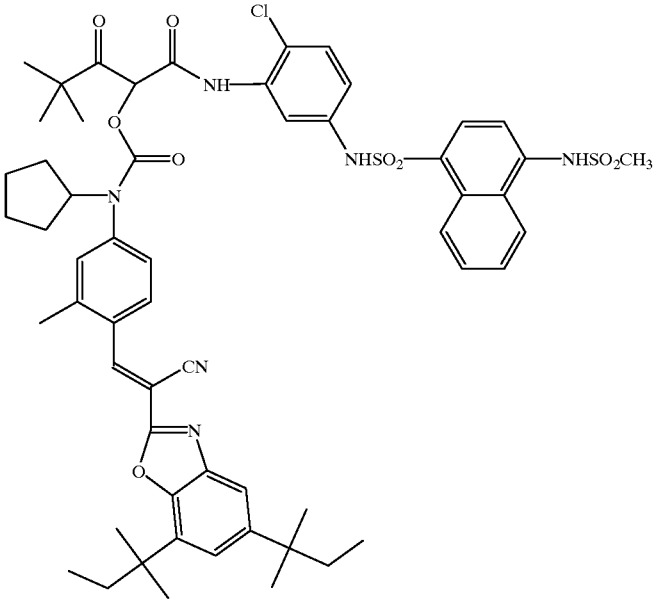
YC-3
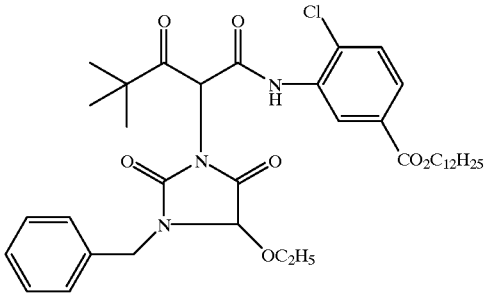
YC-4
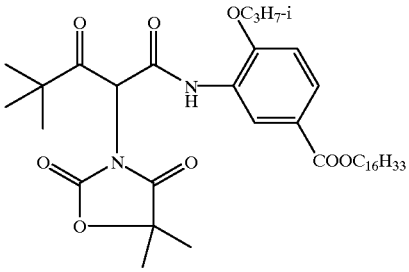

-continued
YC-5
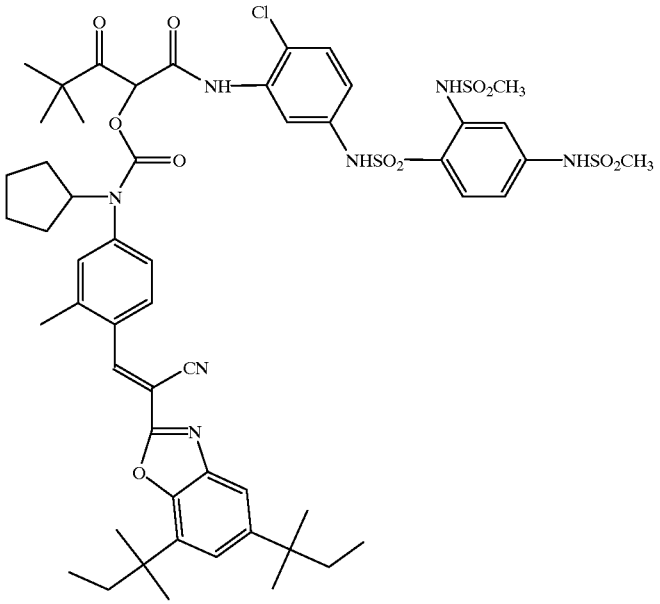
YC-6
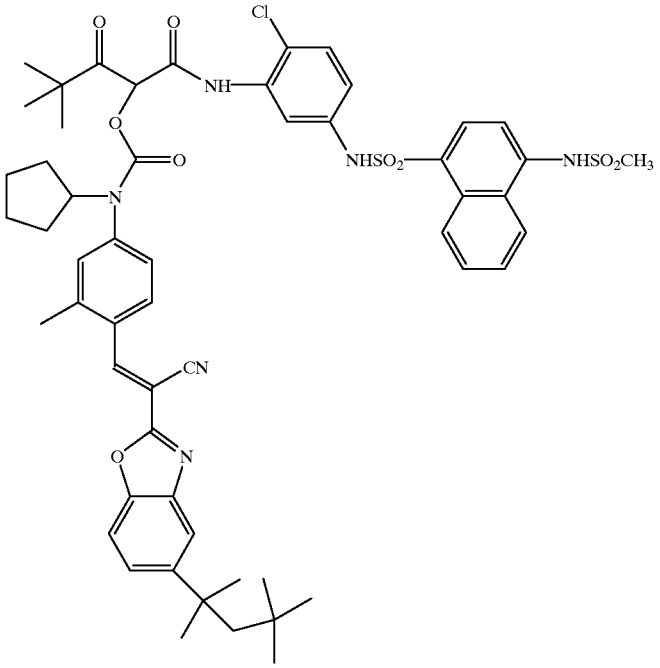

-continued

YC-7

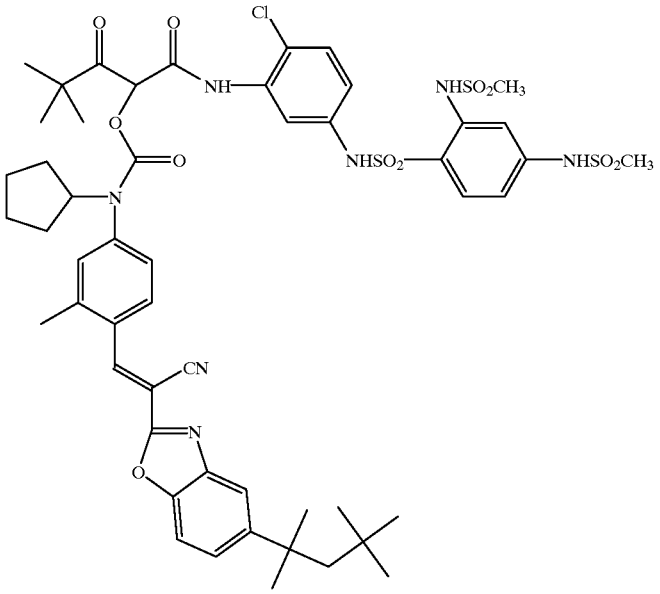

Single layer results are based on gamma changes, which indicate a change in coupling activity. When the pH of the developer solution is changed between 9.75 through 10.05 to 10.35, this simulates changes that might occur in the photoprocessing trade. The less the gamma changes over this range, the better, as no change predicts a more robust coupling system which would yield consistent results even though the process varies. In the single layer experiments, the ratio of gamma at pH 9.75 to gamma at 10.35 is calculated. The closer to unity the better. A high gamma at pH 9.75 is also advantageous, and is an indicator of improved coupling activity.

Example 1

Single layer photographic samples were prepared as follows with amounts being in g/m$^2$ unless otherwise specified.

| Single Layer Format. | |
|---|---|
| Layer 2 | Gelatin at 1.08<br>Hardener ((Bis-vinylsulfonyl)methane) at 2%<br>Spreading agent (Saponin 1%) |
| Layer 1 | Gelatin at 2.69<br>Emulsion - tabular silver iodobromide 3 × 0.14$\mu$, 4.1 mole % Iodide, at 0.65<br>Image Coupler at 0.27 mmol/m$^2$(HDY dye-releasing couplers)or 0.54 mmol/m$^2$(conventional couplers)<br>Spreading agent (Saponin 1%) |
| Anti-halation Layer | Black Colloidal Silver at 0.344, and gelatin at 2.44. |
| Film Base | |

Unless otherwise specified, the boosters are coated at half the weight of the couplers, not based on molar levels. Coated strips were exposed using a conventional step-wedge and processed using the Kodak Flexicolor C-41 process.

TABLE I

| Sample | Type | Addendum | γ | γ @ pH = 9.75 | γ @ pH9.75/ γ @ pH10.35 (Ratio) |
|---|---|---|---|---|---|
| 1 | Check | None | 0.86 | 0.46 | 0.48 |
| 2 | Inv | Inv-17 | 0.88 | 0.50 | 0.50 |
| 3 | Inv | Inv-14 | 1.02 | 0.68 | 0.63 |

Compared to the check, the lightly ballasted Inv-17 showed some effect, while the more ballasted Inv-14 greatly improved the performance of YC-2. Just incoporating the inventive compound does give improved activity.

TABLE II

| Sample | Type | Addendum | γ | γ @ pH = 9.75 | γ @ pH9.75/ γ @ pH10.35 (Ratio) |
|---|---|---|---|---|---|
| 1 | Check | None | 0.86 | 0.46 | 0.48 |
| 4 | Inv | Inv-11 | 0.99 | 0.63 | 0.62 |
| 5 | Inv | Inv-13 | 1.00 | 0.63 | 0.61 |
| 6 | Inv | Inv-1 | 1.01 | 0.67 | 0.64 |
| 7 | Inv | Inv-15 | 0.97 | 0.61 | 0.61 |
| 8 | Inv | Inv-16 | 0.98 | 0.59 | 0.57 |
| 9 | Comp | Comp-1 | 0.93 | 0.56 | 0.56 |

Each of the compounds useful in the invention improves the activity of the coupler. The comparison Comp-1 provides some benefit, but not at the level of the inventive samples.

Example 2

This example uses a similar format to that used in Example 1 but with the yellow coupler YC-6/addendum dispersed in 2-hexyl-1-decanol (1part).

TABLE III

| Sample | Addendum | DOG γ | γ @ pH = 9.75 | γ @ pH9.75/ γ @ pH10.35 (Ratio) |
|---|---|---|---|---|
| 1 | Inv-1 | 0.94 | 0.67 | 0.69 |
| 2 | Inv-19 | 0.91 | 0.65 | 0.68 |

Both of these compounds improve the activity of the coupler. Both one and two sulfonamides on the activated phenyl ring are effective.

Using YC-7, similarly dispersed, the following results were obtained.

TABLE IV

| Sample | Addendum | DOG γ | γ @ pH = 9.75 | γ @ pH9.75/ γ @ pH10.35 (Ratio) |
|---|---|---|---|---|
| 3 | None | 0.91 | 0.69 | 0.75 |
| 4 | Inv-1 | 0.99 | 0.82 | 0.87 |

The same benefits are obtained with YC-7 as with the other coupler tested.

Example 3

This example uses a similar format to that used in Example 1, but with YC-6 coupler/Inv-1 dispersed in 2-hexyl-1-decanol (1part).

TABLE V

| Sample | Type | Parts Inv-1 /Coupler | γ | γ @ pH = 9.75 | γ @ pH9.75/ γ @ pH10.35 (Ratio) | λmax (nm) |
|---|---|---|---|---|---|---|
| 1 | Comp | 0 | 0.91 | 0.52 | 0.48 | 452 |
| 2 | Inv | 0.1 | 0.96 | 0.60 | 0.57 | 451 |
| 3 | Inv | 0.3 | 1.02 | 0.68 | 0.64 | 451 |
| 4 | Inv | 0.5 | 1.05 | 0.73 | 0.68 | 453 |
| 5 | Inv | 1.0 | 1.13 | 0.82 | 0.77 | 453 |

Activity increases with the level of the addendum. The booster does not change the hue maximum absorbance significantly. It leads to a slight narrowing of the absorbance as measured by the half-band-width.

Samples were similarly prepared using YC-1 as the imaging coupler, dispersed in S-3 (0.5 parts) +/− addendum Inv-1. Testing gave the following results.

TABLE VI

| Sample | Type | Parts Inv-1 | γ | γ @pH = 9.75 | γ @ pH9.75/ γ @ pH10.35 (Ratio) |
|---|---|---|---|---|---|
| 6 | Check | 0 | 0.51 | 0.45 | 0.83 |
| 7 | Inv | 0.5, co-dispersed | 0.48 | 0.42 | 0.78 |
| 8 | Inv | 0.5 separate | 0.55 | 0.46 | 0.78 |

In this case it is believed that the coupler already had a pKa low enough so that the addendum does not boost the activity. The result was the same when either co-dispersed with the coupler or added as a separate dispersion in S-3.

Example 4

Samples were prepared similarly to Example 1 using YC-4 (50 μmoles) dispersed in S-4 (0.5 parts) with or without stabilizers and with or without Inv-1.

TABLE VII

| Sample | Parts Inv-1 | γ | γ @ pH = 9.75 | γ @ pH9.75/ γ @ pH10.35 (Ratio) | In-film pKa |
|---|---|---|---|---|---|
| 1 | 0 | 0.27 | 0.14 | 0.37 | |
| 2 | 0, + blank S-4 | 0.29 | 0.16 | 0.40 | 11.2 |
| 3 | 0.5, separate | 0.36 | 0.21 | 0.48 | 10.9 |

This data shows that the improved activity comes from the addendum not the coupler solvent. In-film pKa measurements confirmed that the addenda reduced the effective pKa of the YC-4 by 0.3 units, making the coupler more ionized at developer pH and so more available to react with oxidized developer.

Using a similar S-4 dispersion, and comparing whether the addenda is added to the emulsion separately from the coupler dispersion vs. first co-dispersing the addenda and coupler together, the following results were obtained.

TABLE VIII

| Sample | Parts Inv-1 /Coupler | γ | γ @ pH9.75 | γ @ pH9.75/ γ @ pH10.35 (Ratio) |
|---|---|---|---|---|
| 4 | 0 | 0.36 | 0.21 | 0.46 |
| 5 | 0.5, separate | 0.41 | 0.27 | 0.56 |
| 6 | 0.5, co-dispersed | 0.41 | 0.25 | 0.52 |

The data shows that the improvement is not dependent on whether the addenda is dispersed with the coupler or is added as a separate dispersion.

With YC-2 (25 μmoles/sq ft) as the coupler dispersed (a) in 2-hexyl-1-decanol (1part) with Inv-1 (1part), or (b) in S-1/S-2 (1:0.5:0.5) and no Inv-1.

TABLE IX

| Part | Type | Dispersion | γ | γ @ pH = 9.75 | γ @ pH9.75/ γ @ pH10.35 (Ratio) |
|---|---|---|---|---|---|
| 7 | Inv | (a) | 1.14 | 0.80 | 0.70 |
| 8 | Check | (b) | 1.04 | 0.53 | 0.46 |
| 9 | Inv | (b) + Inv-1 dispersion | 0.84 | 0.54 | 0.59 |

In this case, the co-dispersion showed an improvement, but addition of Inv-1 as a separate dispersion to a dispersion of YC-2 did not result in as great an improvement.

Example 5

YC-2 was coated as in Example 4 in a variety of solvents with Inv-1 included as part of the coupler dispersion.

TABLE X

| Sample | Coupler solvent | Type | γ | γ @ pH = 9.75 | γ @ pH9.75/ γ @ pH10.35 (Ratio) |
|---|---|---|---|---|---|
| 1 | S-1/S-2, no Inv-1 | Check | 0.96 | 0.52 | 0.50 |
| 2 | as 1 but + 0.5 Inv-1 | Inv | 1.05 | 0.71 | 0.66 |
| 3 | S-7 + 0.5 Inv-1 | Inv | 1.09 | 0.74 | 0.70 |
| 4 | S-5 + 0.5 Inv-1 | Inv | 1.08 | 0.67 | 0.66 |

A considerable improvement is obtained in each coupler solvent, with Inv-1 added as a co-dispersed material.

Example 6

Coupler YC-2 was coated with a variety of addenda as co-dispersions in S-6/S-5 (1:0.5:0.5:0.5 addendum)

TABLE XI

| Sample | Addendum | Type | γ | γ @ pH = 9.75 | γ @ pH9.75/ γ @ pH10.35 (Ratio) | λmax (nm) | hbw (nm) |
|---|---|---|---|---|---|---|---|
| 1 | None | Check | 0.90 | 0.50 | 0.51 | 450 nm | 84 |
| 2 | Inv-1 | Inv | 1.03 | 0.70 | 0.68 | 449 | 82 |
| 3 | Inv-2 | Inv | 1.07 | 0.74 | 0.64 | 450 | 82 |
| 4 | Comp-2 | Comp | 0.96 | 0.54 | 0.55 | 451 | 83 |
| 5 | Comp-3 | Comp | 0.98 | 0.60 | 0.57 | 451 | 83 |
| 6 | Inv-5 | Inv | 0.98 | 0.60 | 0.57 | 450 | 82 |
| 7 | Inv-6 | Inv | 1.01 | 0.67 | 0.64 | 451 | 83 |
| 8 | Inv-7 | Inv | 1.05 | 0.69 | 0.63 | 450 | 82 |
| 9 | Inv-8 | Inv | 1.04 | 0.69 | 0.63 | 450 | 82 |
| 10 | Inv-9 | Inv | 1.07 | 0.74 | 0.67 | 450 | 82 |
| 11 | Inv-10 | Inv | 1.13 | 0.74 | 0.64 | 450 | 82 |

The data shows that the compounds of the invention addenda generally provide improved activity. Inv-1, Inv-2, and Inv-6 to 10 are the most effective. All have sulfonyloxy activating groups. Dye hue is relatively unaffected by the presence of a wide range of addenda. Sample 6 is not markedly superior to sample 5 but the balance of the inventive samples show a clear advantage.

Example 7

With CC-1 dispersions in S-4 at 1:1, with and without Inv-1 at 0.5 parts co-dispersed, this coupler shows improved activity from the addenda. Since the coupler has very little sensitivity to developer pH (γ9.75/10.35 approaches unity) the addition of addenda did little to improve on this parameter.

TABLE XI

| Sample | Addendum | γ |
|---|---|---|
| 1 | check | 0.87 |
| 2 | Inv-1 | 0.90 |
| 3 | Inv-11 | 0.93 |
| 4 | Inv-14 | 0.97 |
| 5 | Inv-13 | 0.96 |

These results show that coupler activity was improved by addition of the addenda.

Example 8

Comparative and inventive samples were identically prepared and processed using a variation in the format, dispersion detail, and processing compared to Example 1 using 25% addendum based on the coupler amount. The ratio of gamma from a regular KODAK PROCESS C-41 development to the gamma from a similar process where the standard competing compound, citrazinic acid, is added to the developer, gives a measure of the activity of the coupler to oxidized developer. That is, how well does the coupler compete with citrazinic acid, for oxidized developer, in the presence versus the absence of the boosting addendum Inv-1.

TABLE XII

| Coupler | Dmin | Dmax | γ | γCZA | γratio |
|---|---|---|---|---|---|
| YC-3 | 0.13 | 2.16 | 1.66 | 0.70 | 0.42 |
| YC-3/Inv-1 | 0.13 | 2.17 | 1.71 | 0.81 | 0.47 |
| YC-1 | 0.16 | 2.26 | 1.80 | 1.01 | 0.56 |
| YC-1/Inv-1 | 0.15 | 2.33 | 1.86 | 1.02 | 0.55 |
| YC-4 | 0.11 | 1.43 | 0.95 | 0.29 | 0.31 |
| YC-4/Inv-1 | 0.12 | 1.80 | 1.33 | 0.55 | 0.41 |
| MC-2 | 0.08 | 0.72 | 0.42 | 0.07 | 0.17 |
| MC-I/Inv-1 | 0.09 | 0.93 | 0.58 | 0.12 | 0.21 |

The data show for YC-3, the ratio desirably increases (0.42 to 0.47) indicating some boost by Inv-1. The same is true for YC-4 (0.31 to 0.41). No boost is seen with YC-1 in agreement with Table VI. The magenta coupler MC-2 (0.17 to 0.21) also shows an improved activity in the presence of the compound of the invention.

Example 9

Coatings of YC-2 were prepared, where the coupler (1 part) was dispersed in a mixture of S-5 (0.5 part) and S-6 (0.5 part), +/− a booster.

TABLE XIII

| Part | Addendum | γ | γ @ pH = 9.75 | γ @ pH9.75/ γ @ pH10.35 (Ratio) |
|---|---|---|---|---|
| 04 | — | 0.92 | 0.45 | 0.45 |
| 05 | Inv-20 | 0.99 | 0.62 | 0.56 |
| 06 | Comp-4 | 1.03 | 0.55 | 0.49 |
| 07 | Comp-5 | 1.04 | 0.58 | 0.51 |
| 08 | Comp-6 | 1.02 | 0.56 | 0.54 |
| 10 | Inv-1 | 0.99 | 0.63 | 0.61 |
| 11 | Inv-2 | 0.96 | 0.60 | 0.59 |

This data shows that Inv-20 most closely matched the good effects of Inv-1 and Inv-2. It appears that 1 to 4 carbons linked to the $SO_2$ of the sulfonamide provide desirable results. The compounds Comp-4 and Comp-5 are not very effective (in spite of their sulfonamide pKa of Comp-5), and this is believed to be the result of the substituent selection on the phenyl ring. Comp-6 has some activity but is less effective than the compounds useful in the invention.

Example 10

An ISO800 color negative, multi-layer coating ("Element 1") was prepared as described in the following. The format was not changed between the parts shown except for the changes shown below. All other components, silver and couplers, were the same.

Part 06: Fast Yellow Layer YC-2 dispersion A, 17 mg/sq ft

Slow Yellow Layer YC-2 dispersion A, 36.3 mg/sq ft

Part 07: Fast Yellow Layer YC-2 dispersion B, 11.9 mg/sq ft

Slow Yellow Layer YC-2 dispersion A, 36.3 mg/sq ft

Dispersion A 1:0.5:0.5, coupler:S-5:.S-6

Dispersion B 1:0.5:0.5:0.5, coupler:S-5:.S-6: Inv-1

In multilayer coatings, the sensitivity of each color record to developer pH is calculated based on 2 standard deviation variations from the trade average pH of developer solution. The lower the variability number, the more insensitive the film's sensitometric responses are to developer pH. Although maintaining the balance of variability through all three color records is vitally important, for this type of film values for the blue record variability, below about 0.06, using normalized gamma as the metric, are known to show no problems in trade surveys.

| Part | Addendum | max γ | γ pH variability |
|---|---|---|---|
| 06 | check | 0.72 | 0.12 |
| 07 | Inv-1 | 0.81 | 0.07 |

Thus, the inclusion of Inv-1 into the YC-2 dispersion enables the coated laydown of YC-2 to be lowered by about 10%, and still generates a higher gamma. So, further reductions in laydown would be appropriate. Also the variability is reduced by nearly half. These data show the improvements seen by the use of these addenda.

Multi-layers

The Multi-layer film structure utilized is shown below. Component laydowns are provided in units of gm/sq. m. (Bis-vinylsulfonyl)methane hardener at 2% of total gelatin weight was added as a dual melt to layer 1. Antifoggants (including 4-hydroxy-6-methyl-1,3,3a,7-tetraazaindene), surfactants, coating aids, coupler solvents, emulsion addenda, sequestrants, lubricants, matte and tinting dyes were added to the appropriate layers as is common in the art. Samples of each element were given a stepped exposure and processed in the KODAK FLEXICOLOR (C-41) process as described in *British Journal of Photography Annual*, 1988, pp. 196–198.

Element 1:

Layer 1 (Overcoat/UV Filter Layer): silver bromide Lippmann emulsion at 0.215, UV-1 and UV-2 both at 0.108 and gelatin at 1.237.

Layer 2 (Fast Yellow Layer): a blend of two blue sensitized (with BSD-1) silver iodobromide emulsions (i) 1.4 μm, 14 mole % I, 3d, saturated iodide core coated at 0.902, (ii) 3.3×0.13 μm, 1.5 mole %, tabular, coated at 0.412, yellow dye forming coupler YC-1 at 0.424, IR-1 at 0.027, B-1 at 0.011 and gelatin at 1.70.

Layer 3 (Slow Yellow Layer): a blend of three blue sensitized (all with BSD-1) tabular silver iodobromide emulsions (i) 0.96×0.26 μm, 6 mole % I at 0.233, (ii) 1.0×0.13 μm, 1.5 mole % I at 0.081, (iii)) 0.54×0.08 μm, 1.3 mole % I at 0.394, yellow dye forming coupler YC-1 at 0.733, IR-1 at 0.027, B-1 at 0.003 and gelatin at 1.61.

Layer 4 (Yellow filter layer): YFD-1 at 0.108, OxDS-1 at 0.075 and gelatin at 0.807.

Layer 5 (Fast Magenta Layer): a green sensitized (with a mixture of GSD-1 and GSD-2) silver iodobromide tabular emulsion (3.95×0.14 μm, 3.7 mole % iodide) at 1.29, magenta dye forming coupler MC-1 at 0.084, IR-7 at 0.003 and gelatin at 1.58.

Layer 6 (Mid Magenta Layer): a green sensitized (with a mixture of GSD-1 and GSD-2) silver iodobromide tabular emulsion: (i) 2.85×0.12 μm, 3.7 mole % iodide at 0.969, magenta dye forming coupler MC-1 at 0.082, Masking Coupler MM-1 at 0.086, IR-7 at 0.011 and gelatin at 1.56.

Layer 7 (Slow magenta layer): a blend of two green sensitized (both with a mixture of GSD-1 and GSD-2) silver iodobromide tabular emulsions: (i) 0.88×0.12 μm, 2.6 mole % iodide at 0.537 and (ii) 1.20×0.12 μm, 1.8 mole % iodide at 0.342, magenta dye forming coupler MC-1 at 0.285, Masking Coupler MM-1 at 0.075 and gelatin at 1.18.

Layer 8 (Interlayer): OxDS-1 at 0.075 and gelatin at 0538.

Layer 9 (Fast Cyan layer): a red-sensitized sensitized (with a mixture of RSD-1 and RSD-2) iodobromide tabular emulsion (4.0×0.13 μm, 4.0 mole % I) at 1.291, cyan dye-forming coupler CC-2 at 0.205, IR-4 at 0.025, IR-3 at 0.022, OxDS-1 at 0.014 and gelatin at 1.45.

Layer 10 (Mid Cyan Layer): a red-sensitized (all with a mixture of RSD-1 and RSD-2) iodobromide tabular emulsion (2.2×0.12 μm, 3.0 mole % I) at 1.17, cyan dye-forming coupler CC-2 at 0.181, IR-4 at 0.011, masking coupler CM-1 at 0.032, OxDS-1 at 0.011 and gelatin at 1.61.

Layer 11 (Slow cyan layer): a blend of two red sensitized (all with a mixture of RSD-1 and RSD-2) silver iodobromide emulsions: (i) a larger sized iodobromide tabular grain emulsion (1.2×0.12 μm, 4.1 mole % I) at 0.265, (ii) a smaller iodobromide tabular emulsion (0.74×0.12 μm), 4.1 mole % I) at 0.312, cyan dye-forming coupler CC-1 at 0.227, CC-2 at 0.363, masking coupler CM-1 at 0.032, bleach accelerator releasing coupler B-1 at 0.080 and gelatin at 1.67.

Layer 12 (Interlayer): OxDS-1 at 0.075 and gelatin at 1.35.

Layer 14 (Antihalation layer): Black Colloidal Silver at 0.344, and gelatin at 2.44.

A second suitable multicolor coating is the following:

Element 2: This was identical to Element 1 with the following exceptions:

Layer 2 (Fast Yellow Layer): Silver iodobromide emulsions (i) 1.4 μm, 14 mole % I, 3d, saturated iodide core coated at 0.437, (ii) 3.3×0.13 μm, 1.5 mole %, tabular, coated at 0.198, coupler YC-1 replaced by YC-2 as shown, B-1 omitted, and gelatin at 1.18.

Layer 3 (Slow Yellow Layer): Silver iodobromide emulsions (i) 0.96×0.26 μm, 6 mole % I at 0.108, (ii) 1.0×0.13 μm, 1.5 mole % I at 0.043, (iii)) 0.54×0.08 μm, 1.3 mole % I at 0.186, yellow dye forming coupler YC-1 replaced by YC-2 as shown, IR-1 at 0.034, B-1 at 0.003 and gelatin at 1.18.

Layer 5 (Fast Magenta Layer): Silver iodobromide tabular emulsion (3.95×0.14 μm, 3.7 mole % iodide) at 1.10, magenta dye forming coupler MC-1 at 0.071, and gelatin at 1.51.

Layer 6 (Mid Magenta Layer): Silver iodobromide tabular emulsion: (i) 2.85×0.12 μm, 3.7 mole % iodide at 0.823, magenta dye forming coupler MC-1 at 0.058, and gelatin at 1.45.

Layer 7 (Slow magenta layer): Silver iodobromide tabular emulsions: (i) 0.88×0.12 μm, 2.6 mole % iodide at 0.414 and (ii) 1.20×0.12 μm, 1.8 mole % iodide at 0.295, magenta dye forming coupler MC-1 at 0.271, and gelatin at 1.08.

Layer 9 (Fast Cyan layer): iodobromide tabular emulsion (4.0×0.13 μm, 4.0 mole % I) at 0.907, cyan dye-forming coupler CC-2 at 0.172, and gelatin at 1.31.

Layer 10 (Mid Cyan Layer): iodobromide tabular emulsion (2.2×0.12 μm, 3.0 mole % I) at 0.882, cyan dye-forming coupler CC-2 at 0.172, and gelatin at 1.40.

Layer 11 (Slow cyan layer): Silver iodobromide emulsions: (i) a larger sized iodobromide tabular grain emulsion (1.2×0.12 μm, 4.1 mole % I) at 0.194, (ii) a smaller iodobromide tabular emulsion (0.74×0.12 μm), 4.1 mole % I) at 0.263, cyan dye-forming coupler CC-1 at 0.187, CC-2 at 0.281.

Chemical Structures

B-1

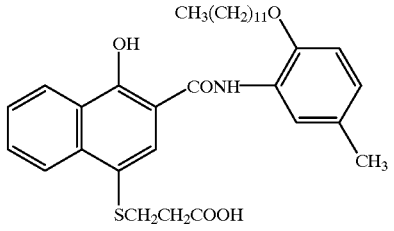

CC-1

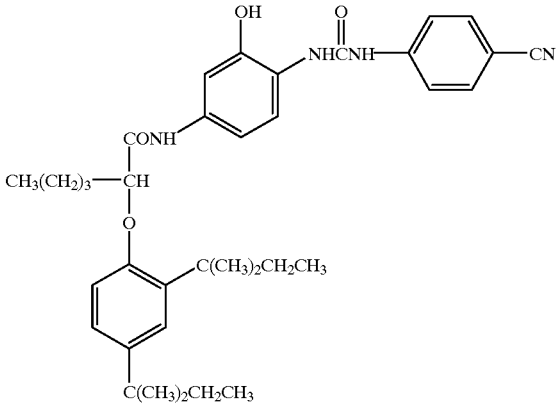

-continued
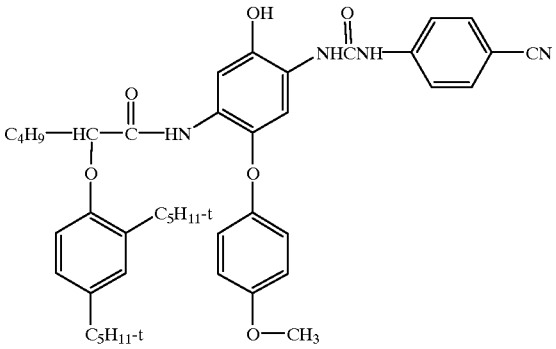
CM-1
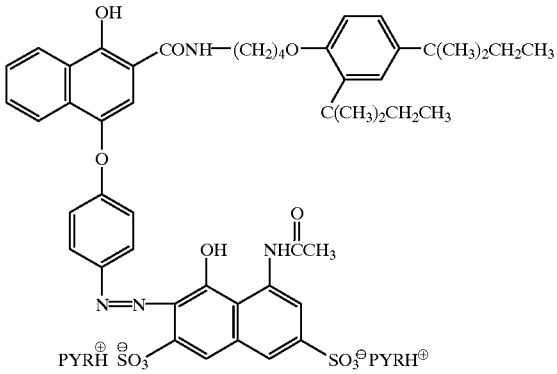
IR-1
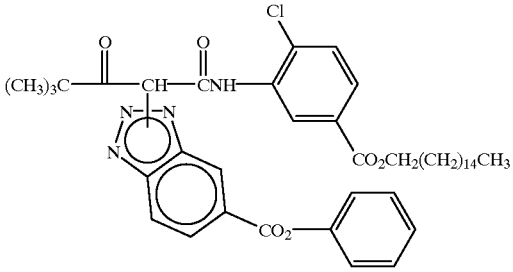
IR-3
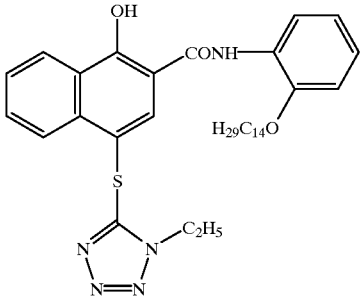
IR-4
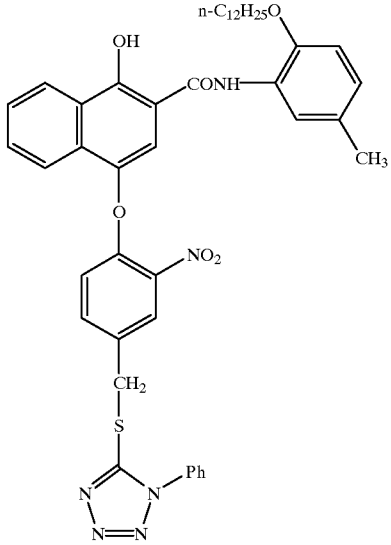
IR-7
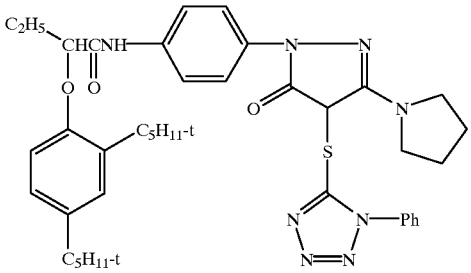

-continued
MC-1
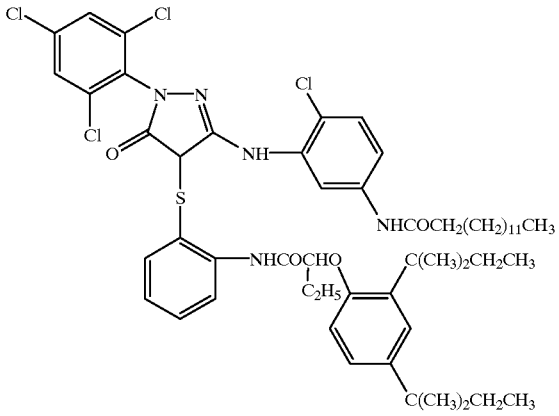
MM-1
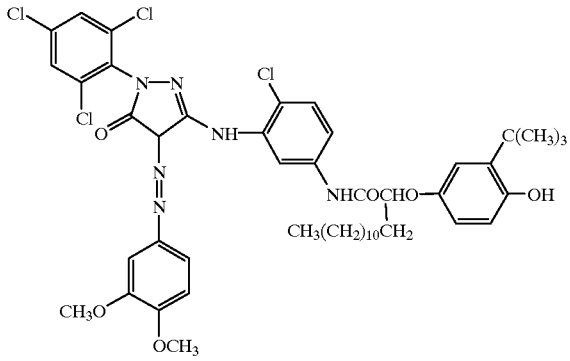
OxDS-1
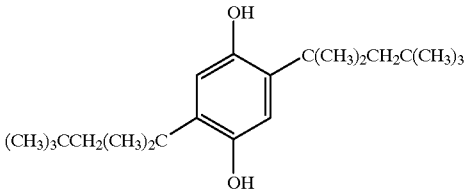
UV-1
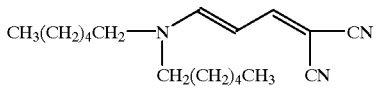
UV-2
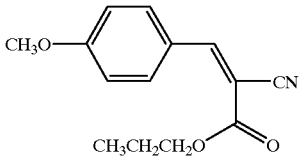
YC-1
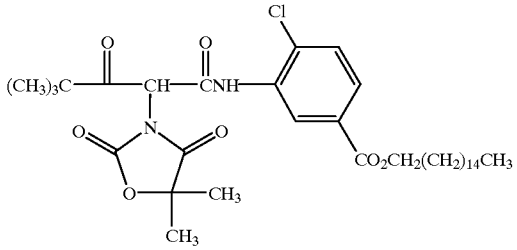
YFD-1
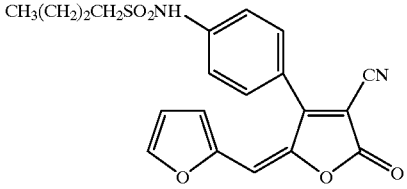
BSD-1
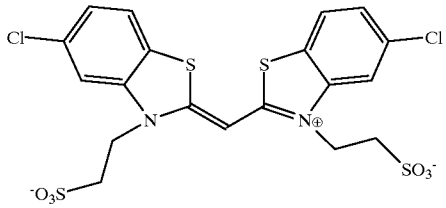
GSD-1
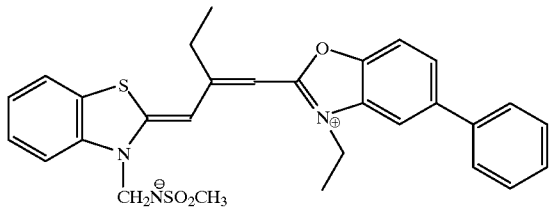
GSD-2
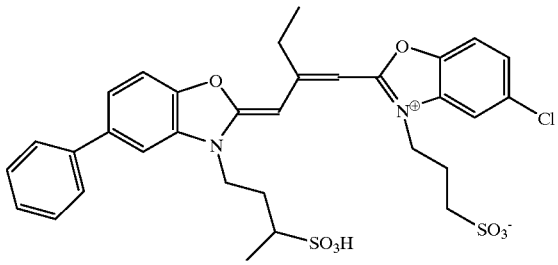

-continued

RSD-1

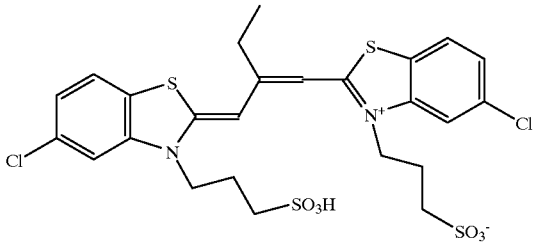

RSD-2

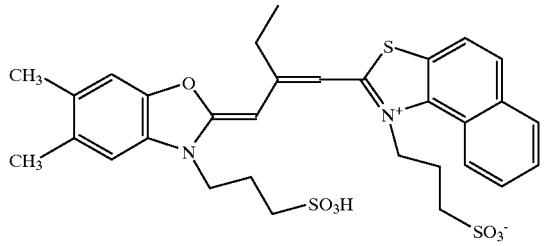

The invention has been described in detail with particular reference to certain preferred embodiments thereof, but it will be understood that variations and modifications can be effected within the spirit and scope of the invention.

The entire contents of the patents and other publications referred to in this specification are incorporated herein by reference.

What is claimed is:

1. A photographic element comprising a light-sensitive silver halide emulsion layer having associated therewith a dye-forming coupler compound and a sulfonamido compound (a) bearing on the sulfur atom of the sulfonamido group an alkyl group and (b) bearing on the nitrogen atom of the sulfonamido group both a hydrogen atom that exhibits a pKa value of less than 9 and a second substituent that is either (1) an aryl group containing one or more electron withdrawing substituents for which the sum of the Hammett's values ($\Sigma\sigma_p$) is greater than 0.5, or (2) a heteroaryl group.

2. The element of claim 1 wherein the alkyl substituent on the sulfur atom of the sulfonamido group contain form 1 to 4 carbon atoms.

3. The element of claim 2 wherein the alkyl substituent is a methyl group.

4. The element of claim 1 wherein the nitrogen atom of the sulfonamido group bears a heteroaryl group.

5. The element of claim 1 wherein the nitrogen atom of the sulfonamido group bears an aryl group containing one or more electron withdrawing substituents for which the sum of the Hammett's values ($\Sigma\sigma_p$) is greater than 0.5.

6. The element of claim 5 wherein said aryl group contains a substituent selected from those having the formula —$SO_2R$ where R is an alkyl, aryl, alkoxy, aryloxy or an alkyl- or arylamino group.

7. The element of claim 6 wherein R is an aryloxy group.

8. The element of claim 7 wherein R is a phenoxy group.

9. The element of claim 7 wherein R is a naphthoxy group.

10. The element of claim 6 wherein R is an amino group.

11. The element of claim 5 wherein the aryl group is a phenyl group.

12. The element of claim 11 wherein said phenyl group contains a substituent selected from those having the formula —$SO_2R$ where R is an alkyl, aryl, alkoxy, aryloxy or an alkyl- or arylamino group.

13. The element of claim 12 wherein R is an aryloxy group.

14. The element of claim 13 wherein R is a phenoxy group.

15. The element of claim 13 wherein R is a naphthoxy group.

16. The element of claim 12 wherein R is an amino group.

17. The element of claim 1 wherein the pKa of the hydrogen atom on the nitrogen of the sulfonamido compound is at least 5.

18. The element of claim 1 having the formula:

$$(R^1—SO_2NH—)_x—R^2$$

wherein $R^1$ is an alkyl group;

$R^2$ is either (1) an aryl group containing one or more electron withdrawing substituents for which the sum of the Hammett's values ($\Sigma\sigma_p$) is greater than 0.5, or (2) a heteroaryl group;

x is an integer of 1 to 6; and the pKa of the hydrogen on the sulfonamido nitrogen is less than 9.0.

* * * * *